US005983444A

United States Patent [19]

Jacobs et al.

[11] Patent Number: 5,983,444

[45] Date of Patent: Nov. 16, 1999

[54] VACUUM CLEANER WITH A MOTOR CASING

[75] Inventors: Carsten Jacobs, Sprockhövel; Hans-Peter Arnold, Wülfrath; Uwe Heider, Hürth; Helmut Schönhoff, Remscheid, all of Germany

[73] Assignee: Vorwerk & Co. Interholding GmbH, Wuppertal, Germany

[21] Appl. No.: 08/952,048

[22] PCT Filed: Mar. 3, 1997

[86] PCT No.: PCT/EP97/01054

§ 371 Date: Oct. 31, 1997

§ 102(e) Date: Oct. 31, 1997

[87] PCT Pub. No.: WO97/32511

PCT Pub. Date: Sep. 12, 1997

[30] Foreign Application Priority Data

Mar. 4, 1996 [DE] Germany ..... 196 08 247

[51] Int. Cl.[6] ..... A47L 9/32

[52] U.S. Cl. ..... 15/329; 15/339; 15/344; 15/410; 15/DIG. 10

[58] Field of Search ..... 15/329, 339, 344, 15/410, DIG. 10; 200/331, 332.2

[56] References Cited

U.S. PATENT DOCUMENTS 4,052,767 10/1977 Dutcher ..... 15/410
4,905,343 3/1990 Jailor ..... 15/339
5,226,527 7/1993 Maurer et al. ..... 200/331
5,740,583 4/1998 Shimada et al. ..... 15/377

FOREIGN PATENT DOCUMENTS 8807720 8/1988 Germany .
9318460 3/1995 Germany .
9528867 11/1995 WIPO .

*Primary Examiner*—Robert J. Warden, Sr.
*Assistant Examiner*—Theresa T. Snider
*Attorney, Agent, or Firm*—Martin A. Farber

[57] ABSTRACT

A vacuum cleaner having a motor casing (G), optionally having a connected filter chamber, and an appliance stem (St), it being possible to plug the appliance stem (St) into a plug receptacle (21) close to the motor casing (G), and a power switch (24), which is arranged in the motor casing (G), being actuated on plugging in the appliance stem (St). In order to improve such a vacuum cleaner with regard to the switching-over of the motor-casing-side power switch effected by the appliance stem, the power switch (24), which is formed as a sliding switch, has a remote-actuation extension (48), which is acted on by plugging in the appliance stem (St) with simultaneous actuation of the power switch (24).

15 Claims, 9 Drawing Sheets

N
23
22
2
9
1
St
40
21
24
G
20
10

N
18
2
9
23
22
St
62
61
1
40
21
24
20
G
10

N
2
40
21
24
20
1
G

Fig. 4
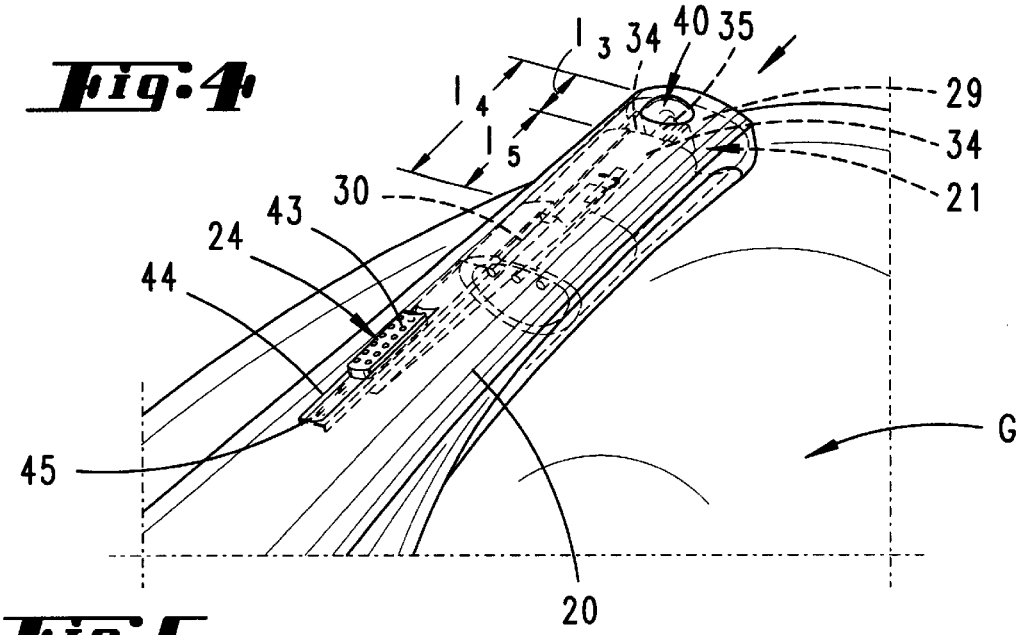
Fig. 5
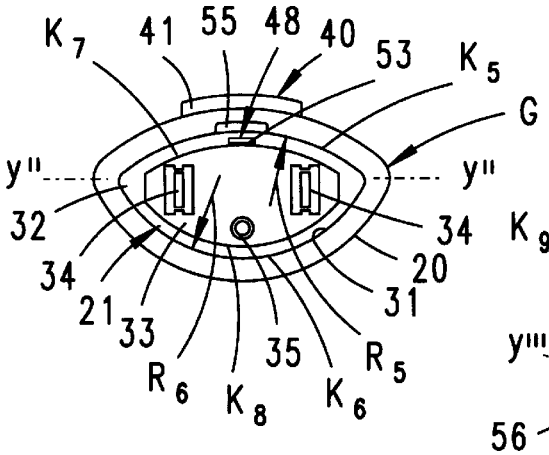
Fig. 6
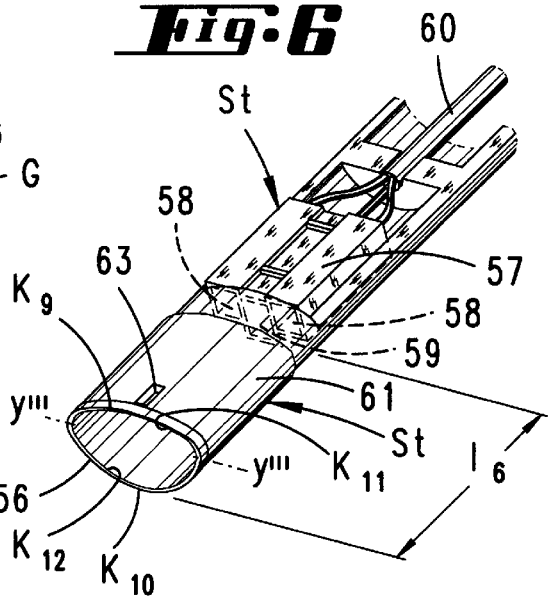
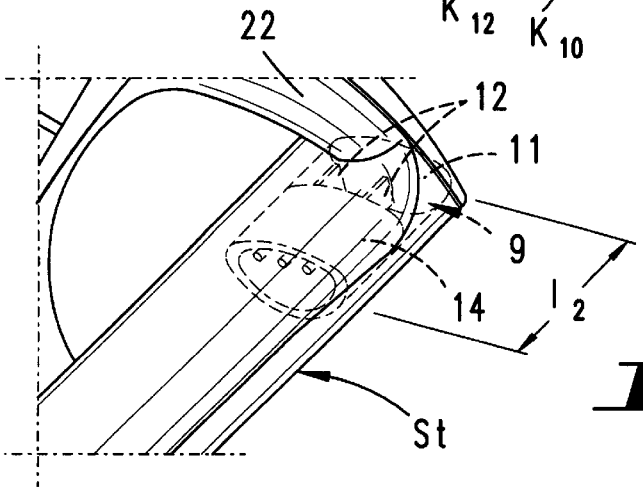
Fig. 7

Fig. 13
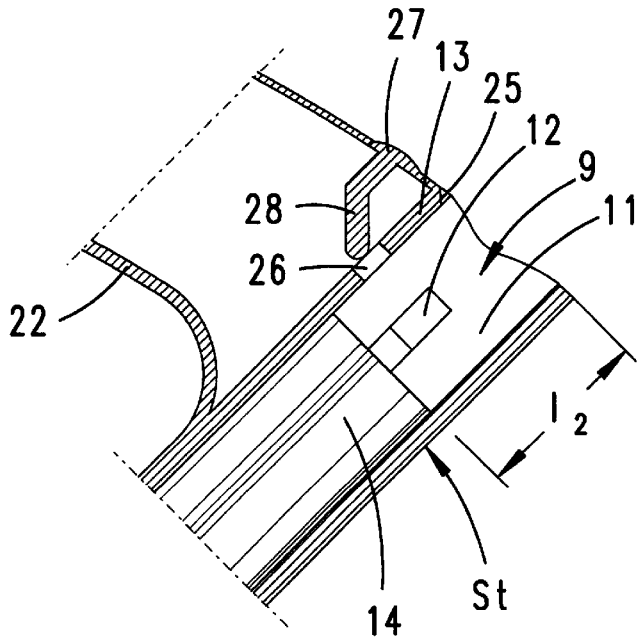
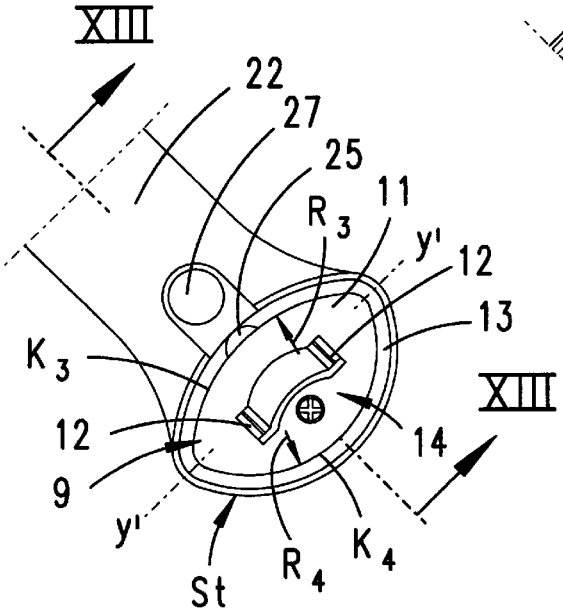
Fig. 12
Fig. 14
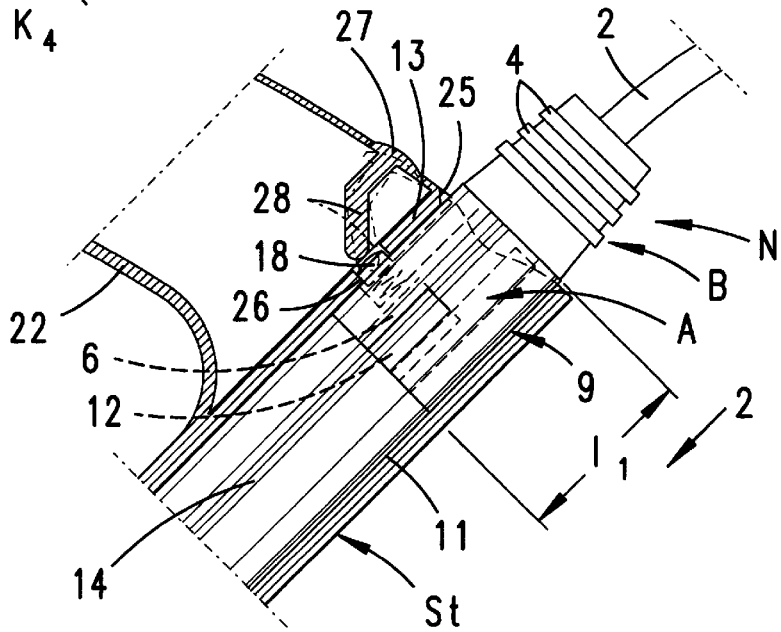

55
37
21
39
40
33
52
34
53
32
35
51
54
46
29
45
48
24
43
44
38
30
47
50
36
49
20
G
41
42
31
33
29
20
38
30
G

St
r
55
62
40
39
52
33
53
57
37
32
34
51
35
54
61
21
45
56
48
29
38
43
30
24
39
61
St
41
34
44
47
40
35
45
50
63
36
53
52
49
51
31
20
32
G
51
54
56
48
46
33
50
21
45
20
29
49
38
36
30
47
G

VACUUM CLEANER WITH A MOTOR CASING

FIELD AND BACKGROUND OF THE INVENTION

The invention relates to a vacuum cleaner having a motor casing, optionally having a connected filter chamber, and an appliance stem, it being possible to plug the appliance stem into a plug receptacle close to the motor casing and a power switch arranged in the motor casing being actuated on plugging in the appliance stem.

Vacuum cleaners of this kind are known. For example, WO 95/28867 has disclosed a vacuum cleaner which has an appliance stem which can be anchored in the motor casing. When plugged into the motor casing or pulled out thereof, the stem actuates a change-over switch arranged in the motor casing. The switch electronically activates or deactivates, depending on the current state, a motor-casing-side power switch. When the appliance stem is plugged into the motor casing, the motor-casing-side power switch is electronically driven into the full load position, so that a further power switch, which is connected in series therewith, in the appliance stem or in a handle of the appliance stem is activated. The electric motor of the vacuum cleaner is driven only via the appliance-stem-side power switch. When the appliance stem is pulled out of the motor casing, the change-over switch is actuated in such a manner that the motor-casing-side power switch is switched over into an OFF position. The latter switch is thus the active power switch. Vacuum cleaners with the appliance stem removed are preferably used for working above the floor, in which case the power of the suction motor is controlled using the motor-casing-side power switch.

SUMMARY OF THE INVENTION

With a view to the prior art described above, a technical problem underlying the invention is that of improving a vacuum cleaner of the type under discussion with regard to switching over the motor-casing-side power switch by means of the appliance stem.

This problem is initially and substantially solved with the present invention which covers the situation where the power switch, which is formed as a sliding switch, has a remote-actuation extension, which is acted on by plugging in the appliance stem with simultaneous actuation of the power switch. Consequently, in this case switching is performed mechanically. There is no need for any electronic components and circuits which are susceptible to faults. The power switch, which is formed as a sliding switch, in the motor casing has a remote-actuation extension which can interact with the appliance stem and with the aid of which the sliding switch is preferably moved into a full load position by plugging the appliance stem into the motor casing. Here too, as already indicated in the prior art, the motor-casing-side power switch is connected in series with a second, appliance-stem-side switch, which is preferably located in the region of an appliance-stem handle. The power switch which is on the handle side when the appliance stem has been plugged in is activated due to the series connection and the full load position of the casing-side power switch. The handle-side power switch can now be used to control the power of the suction motor. The remote-actuation extension may be integrally connected, in terms of material, to the actuation region of the power switch. Furthermore, the design may be such that the motor-casing-side power switch automatically moves back into the OFF position, for example by means of a tension spring or the like, when the appliance stem is removed from the motor casing.

This ensures that the suction motor is switched off when the appliance stem is removed. The power to the suction motor is consequently controlled only by means of the motor-casing-side power switch. In an advantageous development of the subject-matter of the invention, it is provided that the remote-actuation extension has a latching projection at its appliance-stem-side end for interaction with a latching recess on the appliance stem. When the appliance stem is plugged into the motor casing, the latching recess of the appliance stem receives the latching projection of the remote-actuation extension and, by means of this extension, moves the power switch into a full-load position. Due to the positively locking connection between the latching projection of the remote-actuation extension and the latching recess of the appliance stem, pulling out the appliance stem moves the power switch back into the OFF position. The remote-actuation extension may in this case, for example, be of elastic design, at least in the region of the latching projection, so that on reaching the OFF position of the power switch, the latching projection resiliently leaves the latching recess of the appliance stem when the appliance stem is pulled out further. To this end, it is furthermore proposed that an appliance-stem-side end of the remote-actuation extension is entrained, when the appliance stem is pulled out, to the maximum extent into a position which is displaced rearwards with regard to an opening of the plug receptacle. The remote-actuation extension or the latching projection of the latter consequently does not project beyond the opening of the plug receptacle after the appliance stem has been pulled out of the latter, as a result of which the remote-actuation extension always remains in a protected position inside the plug receptacle.

It proves particularly advantageous that the appliance-stem-side end of the remote-actuation extension can be displaced within a gap between a plug receptacle inner wall and a plug arranged in the plug receptacle. As a result, the remote-actuation extension is guided and its position secured inside the plug receptacle, thus also always providing secure location of the latching projection in the latching recess of the appliance stem. The plug arranged in the plug receptacle forms the electrical coupling to a coupling part which can be associated with the plug in the appliance stem. Furthermore, it is proposed that the displacement is limited by a stop on a plug rear side. For example, for this purpose, the remote-actuation extension may have an integrally moulded stop catch which strikes against the rear side of the receptacle-side plug when the appliance stem is pulled out, in order to define the OFF position of the power switch. In an advantageous refinement of the subject-matter of the invention, it is proposed that the outermost position of the appliance-stem-side end of the remote-actuation extension is aligned with the plug in such a manner that contact lugs arranged on the plug project beyond the free end of the remote-actuation extension. It is thus ensured that only an appliance stem whose latching recess projects in terms of its plane beyond its plug coupling can move the power switch. Furthermore, this design is particularly advantageous if, with the appliance stem removed, a suitable mains (electric power provided by a distant public power company) coupling is introduced into the plug receptacle in order to supply power to the suction motor. This mains coupling may, for example, be designed in the form of a known inlet connector for non-heating appliances. This connector is introduced into the plug receptacle in such a manner that the contact lugs of the motor-casing-side plug are captured in order to form the electrical coupling.

In this case there is no effect on the actuation extension. This is also desirable, since with such a configuration, the motor-casing-side power switch should initially remain in an OFF position. This position should only be left intentionally by actuating the switch.

The invention furthermore relates to a vacuum cleaner having a motor casing, optionally having a connected filter chamber, and an appliance stem, it being possible to plug the appliance stem into a plug receptacle close to the motor casing, and the plug having contact lugs. In this case, to improve the coupling between appliance stem and motor casing, it is proposed that the plug is arranged set back in the plug receptacle in such a manner that the front ends of the contact lugs are situated at a distance from the opening of the plug receptacle. The contact lugs of the motor-casing-side plug are thus arranged in a concealed position inside the plug receptacle which is such that they cannot be bent inadvertently, for example when the vacuum cleaner is put down. This measure also ensures a reliable coupling inside the plug receptacle. The inner wall of the plug receptacle here provides lateral guidance for the appliance-stem plug-in female connector. Furthermore, it is proposed that the plug is arranged protruding freely in the plug receptacle. For example, the plug may have a reduced cross-section by comparison with the plug receptacle cross-section. A remote-actuation extension of an appliance-casing-side power switch may, as already described, be positioned in the annular space thus formed between plug and plug receptacle inner wall. The appliance stem to be introduced into the plug receptacle may have a projection which protrudes into the annular space formed for the purpose of actuating this remote-actuation extension.

This projection may, for example, be integrally moulded to an appliance-stem-side plug-in female connector so as to form an extension to the latter. The plug is preferably arranged in the motor casing in such a manner that the plug is fastened in the plug receptacle by means of a plug base. The plug fastened to the plug housing thus projects freely into the plug receptacle. The depth of the annular space formed between plug and plug receptacle inner wall is limited by the plug base, the cross-section of which is matched to the inner cross-section of the plug receptacle. Consequently this also provides a stop limit for an appliance-stem extension for actuating the remote-actuation extension of the power switch. In order to ensure transmission of high mechanical loads between appliance stem and motor casing, it is proposed according to the invention that the appliance stem can be pushed into the plug receptacle over a dimension which corresponds to at least 1.5 times, preferably double, a maximum free dimension of an appliance-stem cross-section. Furthermore, to this end, it is proposed that the distance from the opening of the plug receptacle to the foot of the contact lugs approximately corresponds to the maximum dimension of the appliance-stem cross-section. The result is that the appliance stem preferably enters the annular space, formed between the freely protruding plug and the plug receptacle inner wall, beyond the foot of the contact lugs by the distance from the opening of the plug receptacle to the foot of the contact lugs. The freely protruding length of the casing-side plug is selected accordingly. Furthermore, this configuration results in two regions with different roles in the region of the plug receptacle. The first region, associated with the plug-receptacle opening, forms the electrical coupling region between appliance-stem-side plug-in female connector or a mains plug-in female connector, which may be inserted instead of the appliance stem, and the casing-side plug.

The subsequent second region is designed as coupling region between the appliance stem and a remote-actuation extension of an appliance-casing-side power switch, the length of this second region, i.e. the length of the freely protruding region of the plug, preferably corresponding approximately to the maximum travel of the power switch. Both regions together produce the mechanical coupling region between appliance stem and motor casing, the overall length of which coupling region is dimensioned such that high forces and moments can be transmitted. In an advantageous refinement of the subject-matter of the invention, it is provided that the appliance stem and/or a mains plug-in female connector has a latching stud which projects perpendicular to the plug-in direction and latches in a latching receptacle of the plug receptacle. This latching serves to reliably hold the appliance stem or the mains plug-in female connector inside the plug receptacle. This latching can only be disconnected intentionally in order to release the connection. The latching stud provided on the appliance stem or on the mains plug-in female connector may, for example, be spring loaded in a latching direction perpendicular to the plug-in direction. For example, the latching stud may be provided on the underside with a compression spring. However, designs are also conceivable in which the latching stud is designed as an inherently resilient section partially cut free from the casing sleeve. In a preferred design, the plug-receptacle-side latching recess for receiving the latching stud is provided in the already mentioned first region of the plug receptacle, i.e. in the region of the electrical coupling. To eliminate the latching connection between appliance stem or mains plug-in female connector and plug receptacle, it is proposed that the latching receptacle is provided with an ejector for disengaging the latching stud.

By actuating the ejector, the latching stud is displaced, preferably counter to a spring force, in such a manner that the appliance stem or the mains plug-in female connector can then be removed. It has proven advantageous here for the ejector to comprise a flexible plastics part with an incorporated, for example metallic, throw-out part. In a further embodiment, the latter may also be a rigid plastics part.

Finally, the invention relates to a vacuum cleaner having a motor casing, optionally having a connected filter chamber, and an appliance stem, it being possible to plug the appliance stem into a plug receptacle close to the motor casing, having a mains plug-in female connector, it being possible to plug the mains plug-in female connector into the appliance stem. To improve the vacuum cleaner, the appliance stem on one side has a plug for interacting with the mains plug-in female connector, the plug being set back in a socket receptacle of the appliance stem by the dimension of the maximum free cross-section of the mains plug-in female connector, in that the appliance stem is designed on the other side as a plug-in female connector for interacting with a plug of the plug receptacle, which plug is set back by an identical distance with regard to the appliance-stem-side plug, but it being possible for a hollow section of the appliance stem to at least partially cover the plug of the plug receptacle and the plug-in female connector of the appliance stem being arranged set back in the hollow section by the amount of the coverage distance. In this case, a mains plug-in female connector with at least two flat-pin plug receptacles is preferably used, the mains plug-in female connector being non-circular in cross-section perpendicular to the plug-in direction, with an axis of symmetry running through the largest dimension.

In concrete terms, the design is selected such that a dividing axis runs transversely to the axis of symmetry in such a manner that the cross-section above and below the dividing axis is delimited by a convex line of curvature, the two lines of curvature being essentially in the form of a segment of a circle, with different radii. This results in a type of elliptical cross-section, the transition regions of the two portions of the cross-section preferably likewise being of rounded design. In a preferred embodiment, the radius of that portion of the cross-section which is arranged above the dividing axis is larger than the radius of the line of curvature running below the dividing axis. For example, the radius of the upper convex line of curvature may be 45 to 55 mm, preferably 50 mm, and the lower line of curvature may have a radius of 35 to 40 mm, preferably 37 mm. It is essential that the centre of the line of curvature of larger radius be arranged outside the overall cross-section of the mains plug-in female connector and the centre of the line of curvature of smaller radius lie within the overall cross-section, both centres being positioned on the axis of symmetry of the mains plug-in female connector. Furthermore, it is also possible for the two lines of curvature running above and below the dividing axis each to be composed of a plurality of circular segments of different radii. This results in an easy-to-handle configuration of the mains plug-in female connector. In particular, this design proves easy to grip. Furthermore, this provides the user with a visual aid for putting the plug-in female connector onto the associated plug in the correct position, due to the asymmetric, non-circular design of the cross-section. In an advantageous refinement of the subject-matter of the invention, it is provided for a cross-sectional dimension given by the two transition regions of the different curves to be considerably larger than a largest dimension, perpendicular thereto, of the cross-section.

This results in a relatively flat design of the mains plug-in female connector. In combination with the portions of the cross-section which are designed in the form of segments of a circle above and below the dividing axis, the result is an ergonomically favourable design. The preferred ratios for this are from 15:10 to 20:10, preferably 17:10. In a preferred configuration, a largest cross-sectional dimension is about 34 mm and a dimension running perpendicular thereto is about 20 mm. Furthermore, it is proposed for the length by which the mains plug-in female connector is plugged into the appliance-side or stem-side plug receptacle to be approximately matched to the largest cross-sectional dimension of the mains plug-in female connector. This preferably means a length ratio of largest cross-sectional dimension to plug-in length of about 1:1. Furthermore, it is proposed for the flat-pin plug receptacles to be offset asymmetrically with regard to a joining line between the transition regions, namely towards that portion of the cross-section which has the more strongly curved outline. As already indicated, the mains plug-in female connector is asymmetric with regard to the joining line between the transition regions but symmetrical with regard to the axis running perpendicular to this line. As a result, given a symmetrical arrangement of the flat-pin plug receptacles about the axis running perpendicular to the joining line between the transition regions and given a central arrangement with regard to the overall cross-section of the mains plug-in female connector, the flat-pin plug receptacles are arranged asymmetrically with regard to the joining line. In the preferred design of the mains plug-in female connector, in which lines of curvature which delimit the cross-section and have different radii are provided above and below this joining line, the flat-pin plug receptacles are offset towards the more strongly curved outline, i.e. are more in the region of that portion of the cross-section which has the smaller radius.

It is preferred here to offset the flat-pin plug receptacles parallel to the joining line between the transition regions in such a manner that a joining line between the centres of the flat-pin plug receptacles runs at least approximately through the centroid of the area of the overall cross-section of the plug-in female connector, which centroid—owing to the cross-section being composed of lines of curvature of different radii—does not coincide with the intersection of the joining line between the two transition regions and the axis running perpendicular thereto. The flat-pin receptacles are otherwise modelled on those receptacles which are known in the prior art. They each have an entry region of rectangular cross-section. A metal terminal sleeve which forms the electrical connection is provided in the receptacle opening extending in the longitudinal direction of the mains plug-in female connector. According to the invention, it is furthermore proposed for the mains plug-in female connector to have a latching stud which projects beyond its outer surface and is resilient perpendicular to the extent of the flat-pin plug receptacles. This configuration provides protection against the plug device being pulled out. When the mains plug-in female connector is plugged into an appliance-side and/or stem-side plug receptacle of corresponding design, the latching stud enters a latching recess. This latching can only be disconnected intentionally, for which purpose a suitable button element, in the form of an ejector or the like, may be provided in the region of the plug receptacle.

This is particularly advantageous in vacuum cleaners, since tensile loads on the mains plug-in female connector may here result in the plug connection becoming detached in an undesired manner. Furthermore, it is proposed for the latching stud to be arranged on the less strongly curved outer side. It proves particularly advantageous here for the latching stud to be aligned approximately centrally with regard to the flat-pin plug receptacles. In a preferred configuration, in which the less strongly curved outline of the cross-section of the plug-in female connector forms the upper region of the mains plug-in female connector, there is the resultant advantage that the latching stud is in an ergonomically favourable position when taking hold of the mains plug-in female connector, so that the said stud is very easy to depress by means of the thumb in order to plug the mains plug-in female connector into an appliance-side and/or stem-side plug receptacle. It is also possible to provide the appliance-side and/or stem-side plug receptacle with an inclined run-up surface associated with the latching stud, which surface depresses the latching stud when the mains plug-in female connector is being introduced. In a preferred embodiment, a non-conductive circular plug receptacle is formed, in terms of the cross-section, between the two flat-pin plug receptacles. The circular plug receptacle formed in this way is consequently designed as a blind receptacle without contact sleeve. The plug receptacle in the motor casing is substantially modelled on the female receptacle of the appliance stem. The only difference is that the cross-section of the plug arranged in the plug receptacle is smaller, so that an annular space remains between the plug and the plug receptacle inner wall. To this end, the casing-side plug is arranged on a plug base and projects freely into the interior of the plug receptacle. When the appliance stem is plugged in, a hollow section of the latter passes into the annular space thus formed, which hollow section is arranged as an extension of the appliance-stem-side plug-in female connector.

The cross-section of this appliance-stem-side plug-in female connector is matched to the casing-side plug.

Furthermore, the design is selected such that the mains plug-in female connector can be inserted both into the female receptacle of the appliance stem and into the plug receptacle of the motor casing, i.e. the female receptacle of the appliance stem and the plug receptacle of the motor casing are designed with identical cross-sections. The length of the mains plug-in female connector is selected such that, when it is plugged into the plug receptacle of the motor casing, it does not enter the annular space formed between plug and plug receptacle inner wall. The female receptacle of the appliance stem and the plug receptacle of the motor casing have an internal cross-section which is matched to the cross-section of the mains plug-in female connector and the end portion of the appliance stem. As a result of this design, a guide-in function for the mains plug-in female connector or for the appliance-stem end portion is imparted to the plug receptacles. In the event of the mains plug-in female connector being put onto the plug receptacle in a slightly twisted position, the convex lines of curvature steer the mains plug-in female connector into the plug receptacle. The mains plug-in female connector is automatically moved into the desired plug-in position. Furthermore, the geometries mean that despite there being only a slight asymmetry there is a considerable blocking effect in the event of incorrect handling. If, for example, the mains plug-in female connector is supplied to the plug receptacle in a position twisted through 180°, it cannot be plugged in. In this case, the guide-in function of the plug receptacle mentioned above also does not apply. Also, the user cannot use force to create the coupling, so that incorrect operation is counteracted.

Owing to the above-described configurations, the vacuum cleaner according to the invention can be used in an extremely simple manner for working both on the floor and above the floor, with only one connection line being used. The latter is merely transferred from an upper end of the appliance stem into a plug receptacle of the motor casing. The plug receptacle here fulfils the roles of providing a good transfer of high mechanical loads between appliance stem and motor casing, of coding mains cable or mains plug-in female connector and appliance stem, making electrical contact between appliance stem and motor casing and allowing for a simple insertion and removal of appliance stem and mains plug-in female connector. In order to be able to transmit the forces and moments, the appliance stem, which is preferably produced as a profiled aluminium tube, preferably penetrates at least 80 mm into the plug receptacle. For the electronics in the vacuum cleaner to function, it is absolutely necessary to recognize whether an appliance stem or a mains plug-in female connector has been plugged in. If the appliance stem is plugged in, the electronics use the potentiometer/switch module, which is integrated in the appliance stem, as a set point generator and as a mains switch. By contrast, if the mains plug-in female connector is plugged in, a potentiometer/switch module arranged in the basic appliance serves as the set point generator and mains switch. At the mains cable connection in the upper end of the appliance stem, by contrast to the appliance-stem connection, the only requirements are those of electrical contacting and simple insertion and removal. There are no high mechanical forces occurring here. Moreover, for reasons of space, an insertion length of, for example, 80 mm is in general not possible at this location. The result is that the outer profiles of the appliance stem and the mains plug-in female connector are identical, that the latching of appliance-stem tube and mains plug-in female connector is identical and that appliance stem and mains plug-in female connector are coded.

Furthermore, the plug-in length of the appliance stem is preferably at least 80 mm and the plug-in length of the mains plug-in female connector is preferably at most 35 mm. The latter two dimensions are apparently contradictory, but according to the invention can be reconciled with one another since the electrical contacting is made within 35 mm behind the plug-in opening while the appliance tube has to be pushed in by 80 mm to achieve this. This measure simultaneously provides an elegant way of coding appliance stem and mains plug-in female connector. In addition, it is thus possible to ensure that although both appliance stem and mains plug-in female connector can be plugged into the motor casing as desired, only the mains plug-in female connector can be plugged into the upper end of the appliance stem. Furthermore, the special contour of appliance stem and mains plug-in female connector ensures that it is not possible to use mains cables which will not withstand the high numbers of bending cycles and loads which occur during operation of a vacuum cleaner. Furthermore, it proves advantageous for the potentiometer/switch module arranged in the basic appliance to be moved, when the appliance stem is plugged in, into a position in which the switch is connected through. This is necessary since the power switches in the appliance stem and in the motor casing are arranged in series. To this end, in the arrangement according to the invention, the power switch in the motor casing is pushed into its limit position by the appliance-stem tube which has been plugged in to a length of 80 mm. In order, when converting to above-floor operation, not to allow the entire appliance to start up when the mains plug-in female connector is plugged in, this switch has to be pulled back again into its OFF position when the appliance stem is removed. For this purpose, a coupling is provided between the power switch and the appliance-stem tube.

BRIEF DESCRIPTION OF THE DRAWINGS

With the above and other objects and advantages in view, the present invention will become more clearly understood in connection with the detailed description of a preferred embodiment, when considered with the accompanying drawings of which:

FIG. 4 shows an enlarged detailed illustration from FIG. 2, showing the plug receptacle close to the casing;

FIG. 5 shows an end view of the plug receptacle close to the casing;

FIG. 6 shows a further perspective detailed illustration of an end portion of the appliance stem, corresponding to the plug receptacle, partially cut away;

FIG. 7 shows a further perspective detailed illustration of a region of an appliance-stem-side female receptacle;

FIG. 12 shows an end view of the appliance-stem-side female receptacle;

FIG. 13 shows the section on line XIII—XIII in FIG. 12;

FIG. 14 shows a further view of the vacuum cleaner of FIG. 13, but after the mains plug-in female connector has been pushed into the female receptacle;

FIG. 19 shows a further view of the vacuum cleaner of FIG. 15, but with the appliance stem pushed completely in;

FIG. 20 shows a further view of the vacuum cleaner of FIG. 16, but relating to the illustration in accordance with FIG. 19;

DETAILED DESCRIPTION OF THE PREFERRED EMBODIMENT

Figures 1, 2, 3:
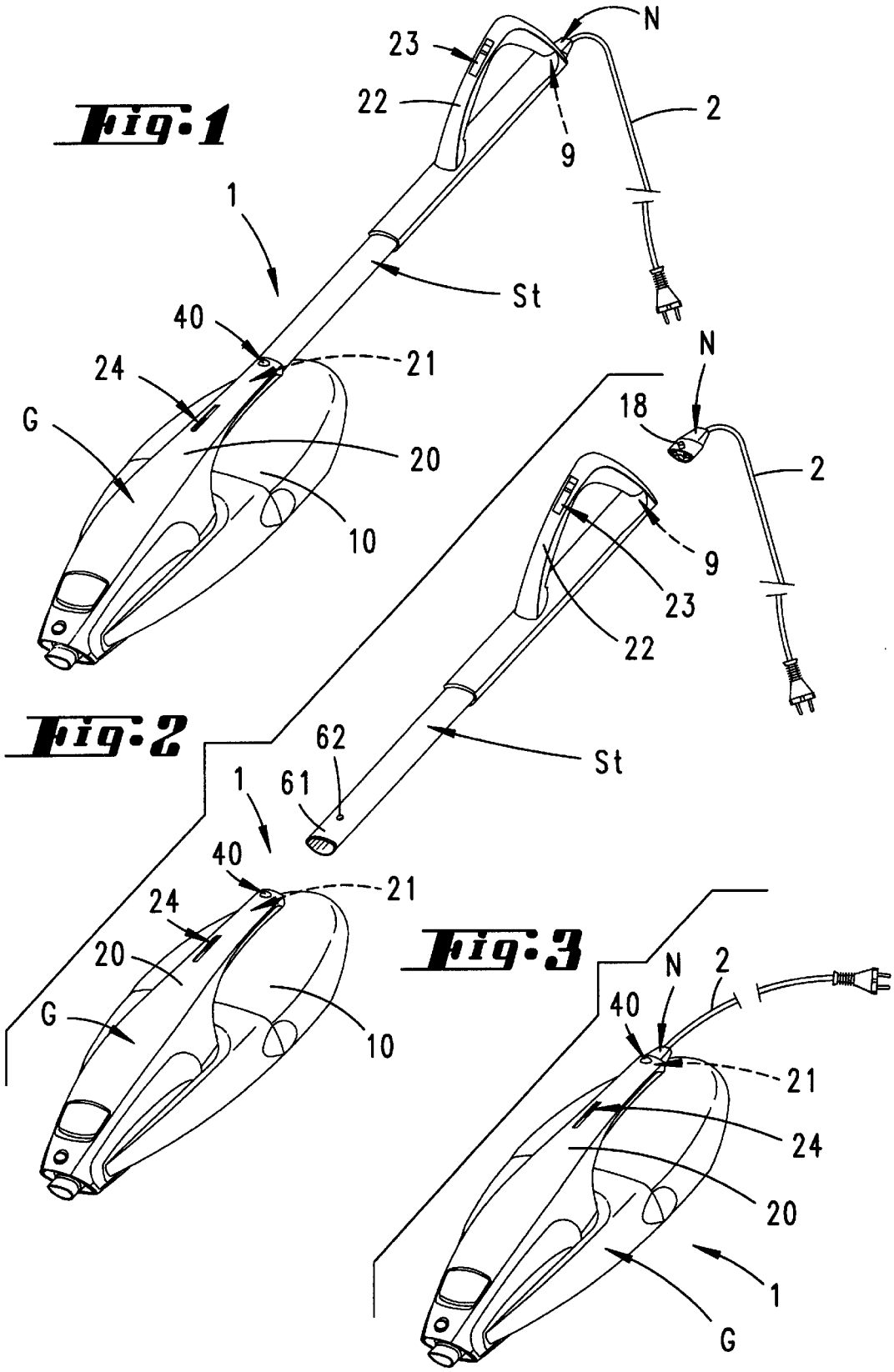
FIG. 1 shows a perspective illustration of a vacuum cleaner according to the invention having a motor casing and a connected filter chamber, with an appliance stem plugged into a plug receptacle close to the casing and a mains plug-in female connector plugged into the appliance stem.
FIG. 2 shows a further view of the vacuum cleaner of FIG. 1, but after the appliance stem has been removed from the motor casing and the mains plug-in female connector from the appliance stem.
FIG. 3 shows a further view of the vacuum cleaner of FIG. 1, but with the omission of the appliance stem, the mains plug-in female connector in this case being plugged directly into the plug receptacle close to the motor casing.
Figure 8:
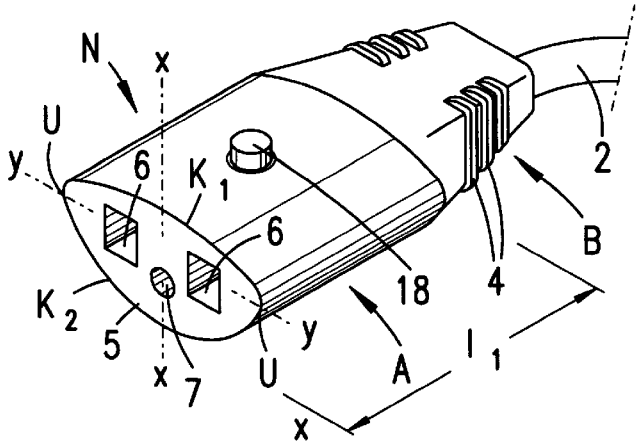
FIG. 8 shows a perspective individual illustration of the mains plug-in female connector.

A vacuum cleaner 1 with a motor casing G and a filter chamber 10 is initially illustrated and described with reference to FIG. 1. The motor casing G has an extension arm 20 with a plug receptacle 21. An appliance stem St, which is preferably designed as an aluminium tube, is plugged into this plug receptacle 21. At its end region remote from the motor casing G, the appliance stem has a handle 22. The electrical connection is produced via a connection line 2, which at one end has a conventional electric plug and at the other end a mains plug-in female connector N designed as an inlet connector for non-heating appliances. This mains plug-in female connector N, in terms of FIG. 1, is plugged into an appliance-stem-side female receptacle 9 associated with the region of the handle 22.

Both appliance stem St and motor casing G each have a power switch 23, 24 formed as a potentiometer/switch module. These power switches 23, 24 are formed as sliding switches, the power switch 23 being positioned in the region of the handle 22 and the power switch 24 being positioned in the region of the extension arm 20 of the motor casing G.

According to the invention, the mains plug-in female connector N can be separated from the appliance stem St and the appliance stem St can be separated from the motor casing G. This is illustrated, for example, in FIG. 2. This results in the possibility of connecting the mains plug-in female connector N directly to the motor casing via the plug receptacle 21, omitting the appliance stem St. Such a configuration is illustrated in FIG. 3. The result is a configuration which is favourable when using the vacuum cleaner 1 for working above the floor.

The mains plug-in female connector N and the female receptacle 9 are described in more detail below with reference to FIGS. 4 to 14.

The cross-section of the mains plug-in female connector N perpendicular to a plug-in direction r is of non-circular design, with an axis of symmetry x running through the largest dimension. As can be seen from FIG. 10, the mains plug-in female connector N is essentially composed of two regions arranged one after the other. Firstly, there is a plug-in region A, which has a dividing axis y running transversely to the axis of symmetry x, by which dividing axis the cross-section is divided into an upper region and a lower region, the two regions having different area dimensions. The second portion of the mains plug-in female connector N adjoins the first portion A and forms a connection portion B. The above-mentioned connection line 2 is arranged on this connection portion B, a conventional pull-out protection (not shown) for the line 2 being present in the portion B. The region B is of frustoconical design and on its outside has ribs 4 to improve the ease of handling.

Above and below the dividing axis y, the cross-section of the plug-in region A is in each case delimited by a convex line of curvature K1 and K2, the two lines of curvature K1 and K2 being substantially in the form of a circular segment. The line of curvature K1 running above the dividing axis y is in this example less strongly curved than the line of curvature K2 running below the dividing axis y, which means that the radius of the upper line of curvature K1 is larger than the radius of the lower line of curvature K2. A gentle transition, in the form of a rounded joining line, is provided in each of the transition regions U between the different lines of curvature K1 and K2. A joining line between these transition regions U forms the abovementioned dividing axis y.

The flat-pin plug receptacles 6 open in the region of the end face 5 of the female connector and are of rectangular design in cross-section. In this case, the longer side of the rectangular cross-section is aligned parallel to the axis of symmetry x with a length/width ratio of about 15:10 or of about 8.5 to 5.5 mm. The two flat-pin plug receptacles 6 are spaced apart from one another by a distance of about 9 mm, parallel to the extent of the dividing axis y, while being arranged symmetrically with regard to the axis x.

Figure 9:
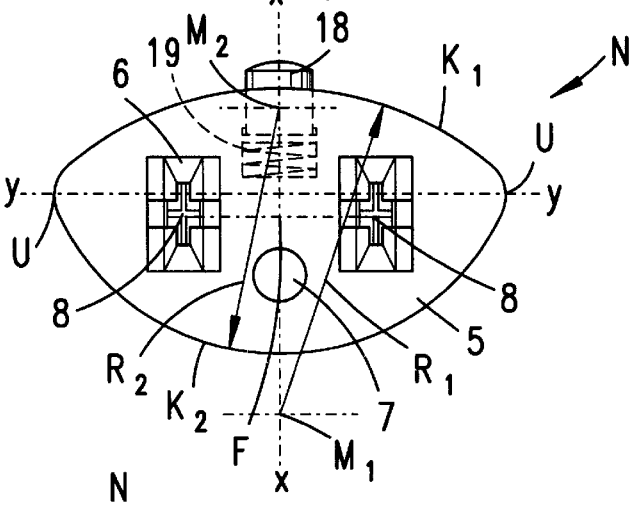
FIG. 9 shows an enlarged end view of the mains plug-in female connector.
Figure 10:
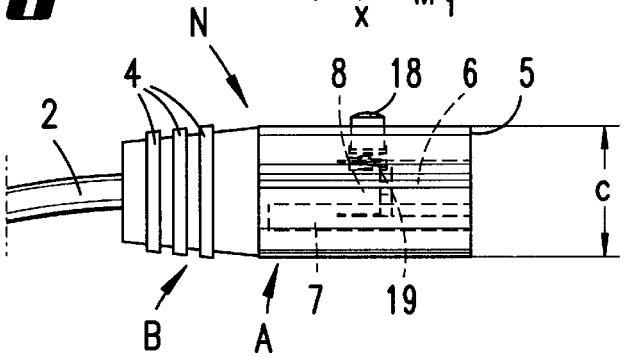
FIG. 10 shows a side view of the mains plug-in female connector.

As can be seen from FIG. 9, the flat-pin plug receptacles 6 are offset asymmetrically with regard to the dividing axis y, namely towards that portion of the cross-section which has the more strongly curved outline K2, in such a manner that a centre axis, running parallel to the dividing axis y, of the two flat-pin plug receptacles 6 runs approximately through the centre F of the surface.

The circular-plug receptacle 7 is arranged, in terms of cross-section, between the two flat-pin plug receptacles 6 and has a circular cross-section. The arrangement here is such that an axis of symmetry of the circular-plug receptacle 7 is aligned with the axis of symmetry x of the mains plug-in female connector N and the axis of symmetry of the circular-pin receptacle 7 running perpendicular to this axis x is virtually aligned in terms of height with the lower edges of the flat-pin plug receptacles 6.

The flat-pin plug receptacles 6 have internally arranged, electrically conductive terminal sleeves 8, to the rear of which the individual wires of the line 2 are connected. The circular-plug receptacle 7 is designed as a blind receptacle, i.e. is non-conductive.

In the exemplary embodiment shown, the radius R1 of the line of curvature K1 is dimensioned to be about 50 mm and the radius R2 of the line of curvature K2 is dimensioned to be about 37 mm (identical in FIG. 9). The transition regions U between the lines of curvature K1 and K2 are likewise designed in the form of segments of a circle.

Furthermore, these dimensions mean that the geometric centre M1 of the line of curvature K1 lies outside the overall cross-section of the mains plug-in female connector N, whereas the geometric centre M2 of the line of curvature K2 is arranged within the overall cross-section. Both geometric centres M1 and M2 are aligned on the axis of symmetry x.

Owing to the asymmetric design of the cross-section, viewed perpendicular to the axis of symmetry x, the resultant centre F of the area does not coincide with the intersection of axis of symmetry x and dividing axis y. Rather, this centre F of the area is formed below the dividing axis y—with regard to FIG. 9—i.e. offset in the direction towards the more strongly curved line of curvature K2.

The geometric dimensions described result in a width/height ratio—with regard to the cross-section—of about 17:10. Related to the exemplary embodiment, this translates into a cross-sectional dimension b given by the two transition regions U of about 34 mm and a largest dimension c perpendicular thereto of about 20 mm.

Figure 11:
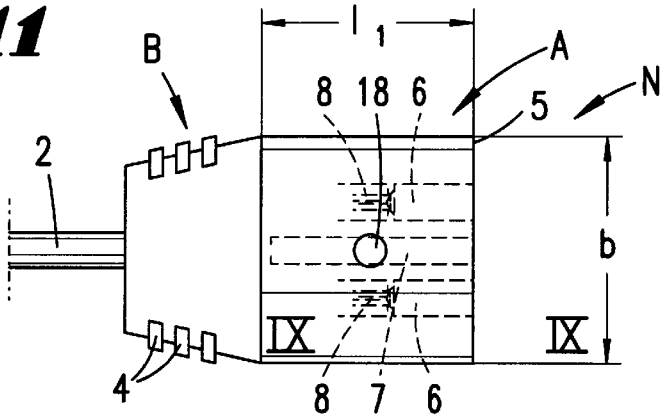
FIG. 11 shows a top view of the mains plug-in female connector.

As can further be seen from FIG. 11, the plug-in region A is dimensioned such that the length 11 of the plug-in region approximately corresponds to the cross-sectional width dimension b.

Furthermore, the mains plug-in female connector N has a latching boss 18 which projects beyond the outer surface and is resilient perpendicular to the extent of the flat-pin plug receptacles 6. In concrete terms, the arrangement here is such that the latching boss 18 is arranged on the upper outer surface, described by the line of curvature K1, of the plug-in region A, to be arranged centrally between the flat-pin plug receptacles 6. Furthermore, the position is selected such that the latching boss 18 is arranged approximately centrally along the longitudinal extent 11 of the plug-in region A.

This latching boss 18 can be displaced counter to a compression spring 19 arranged in the plug-in region A in such a manner that the latching boss 18 descends completely into the outer wall of the plug-in region A.

Positioning the latching boss 18 on the upper side of the plug-in region A, and particularly positioning it approximately centrally thereon, offers the ergonomic advantage of being able to depress the latching boss 18 simply using the pressure of a thumb.

The appliance-stem-side female receptacle 9 is substantially composed of a casing 13 and a plug 14 accommodated in this casing 13. This plug 14 is set back with regard to a front edge of the housing 13, which edge faces the outer wall of the female receptacle 9, so that a cavity is formed in front of the plug 14. Flat-pin plugs 12 arranged on the plug 14 project into this cavity, the length of these flat-pin plugs 12 being shorter than the depth of the cavity measured in the same direction. The flat-pin plugs 12 are electrically conductive and at the rear, in the region of the plug 14, are connected to corresponding connection lines.

As can be seen in particular from FIG. 12, the female receptacle 9, in particular the casing 13 thereof, has a cross-section which corresponds to that of the mains plug-in female connector N. The cross-section of the internal wall of the casing 13 corresponds to that of the outside of the mains plug-in female connector N. The corresponding radii and clear dimensions of the casing 13 are selected to be slightly larger than those of the mains plug-in female connector N, so that the latter can be guided into the female receptacle 9 or into the cavity 11 without problems.

In the case of the female receptacle 9 too, the cross-section is composed of a cross-section portion arranged above a dividing axis y' and a cross-section portion arranged below the dividing axis y'. The upper region is in this case delimited by a convex line of curvature K3 and the lower portion by a line of curvature K4. Here too, the radius of the upper line of curvature K3 is larger than that of the lower line K4.

It can further be seen that both in the mains plug-in female connector N and in the female receptacle 9, the dimension between the two transition regions U is significantly larger than the largest dimension of the cross-section perpendicular thereto.

The abovementioned flat-pin plugs 12 are arranged on the plug 14 in such a manner that when the mains plug-in female connector N is plugged into the female receptacle 9, the flat-pin plugs 12 pass through the flat-pin plug receptacles 6 and enter the terminal sleeves 8 to form a coupling. It can further be seen from FIGS. 13 and 14 that the length 11, measured in the plug-in direction r, of the plug-in region A corresponds to the depth 12 of the female receptacle 9, measured in the same direction, so that after the mains plug-in female connector N has been plugged into the female receptacle 9, only the connection region B of the mains plug-in female connector N emerges from the female receptacle 9. This results in further functions of the two regions A and B.

The region A is the actual coupling region for achieving a plug device. The region B serves as a handling region, in which region the mains plug-in female connector N is held for the purpose of introduction into or removal from the female receptacle 9.

In the region of its casing 13, the female receptacle 9 has an inclined run-up surface 25 which displaces the latching boss 18 of the mains plug-in female connector N counter to the compression spring 19 during the plug-in operation.

In the coupling position in accordance with FIG. 14, the latching boss 18 is received in a housing-side bore 26 of the female receptacle 9. The latching boss 18, which is moved into this bore 26 by the compression spring 19, prevents the mains plug-in female connector N from being unintentionally pulled out of the female receptacle 9.

This coupling can only be released intentionally. To do this, the female receptacle 9 has a button element 27. The latter is integrally moulded on the casing 13 in the region of the plug-in side on the upper, less strongly curved outer surface formed by the line of curvature K3. In the case of a one-piece design, the transition region between casing 13 and button element 27 is of resilient design, for example due to the material being made thinner in the transition region. A disengagement finger 28, which points downwards, i.e. in the direction of the bore 26 of the casing 13, is integrally moulded on the inside of the button element 27.

To release the plug connection, the button element 27 is pressed in, so that the button element 27 tips down together with the disengagement finger 28, the free end of the disengagement finger 28 moving the latching boss 18 backwards, counter to the force of the compression spring 19, so that the latching boss 18 moves out of the region of the casing bore 26. It is thus possible to remove the mains plug-in female connector N.

This embodied pull-out protection is particularly desirable for vacuum cleaners, since here if the plug device did not have a latching mechanism, the mains plug-in female connector N could be pulled out inadvertently during operation, which is undesirable for safety reasons.

The extension arm 20, having the plug receptacle 21, of the motor casing G is of tubular design. The plug receptacle 21 is here positioned in a freely protruding end region of the extension arm 20, an opening cross-section of the plug receptacle 21 corresponding to the opening cross-section of the female receptacle 9 (shown in this connection at FIGS. 5 and 12). This furthermore results in the fact that the cross-section of the inner wall of the plug receptacle 21 corresponds to that of the outside of the mains plug-in female connector N, the radii and clear dimensions of the plug receptacle 21 being selected to be slightly larger than those of the mains plug-in female connector N, so that the latter can be guided into the plug receptacle 21 without problems.

In the case of the plug receptacle 21, the cross-section is composed of a cross-section portion arranged above a dividing axis y" and a cross-section portion arranged below the dividing axis y". In this case, the upper region is delimited by a convex line of curvature K5 and the lower portion by a line of curvature K6. Here too, the radius of the upper line of curvature K5 is larger than that of the lower line K6.

In concrete terms, this means that the radius R5 describing the upper line of curvature K5 substantially corresponds to the radius R1 and the lower radius R6 describing the line of curvature K6 substantially corresponds to the radius R2 of the mains plug-in female connector N.

The plug 29 arranged in the plug receptacle 21 is fastened in the plug receptacle 21 by means of a plug base 30. The plug base 30 has a cross-section which corresponds to the hollow cross-section of the extension arm 20 or of the plug receptacle 21. The plug base 30 is held such that it fits precisely in the plug receptacle 21 and is, for example, adhesively connected to the inner wall of the extension arm 20.

The plug 29 arranged on the plug base 30 projects freely, starting from the base 30, into the space of the plug receptacle 21, for which reason the cross-section of the plug 29 is smaller than that of the plug base 30 or of the inner wall of the plug receptacle 21. Here too, the cross-section is essentially composed of an upper region of curvature K7 and a lower region of curvature K8 which are brought together, the dimensions and radii being directly proportional to those of the plug receptacle 21.

The freely protruding configuration of the plug 29 results in an annular free space 32 between the plug receptacle inner wall 31 and the outer wall of the plug 29. In the exemplary embodiment shown, a distance between plug receptacle inner wall 31 and plug 29 is about 3 mm.

The plug 29 and the plug base 30 are preferably integrally connected to one another in terms of material. The end face 33 of the plug 29 are positioned flat-pin plugs 34 protruding freely into the plug receptacle space 21. The said flat-pin plugs are arranged on the end face 33 so as to correspond to the flat-pin plug receptacles 6 of the mains plug-in female connector N. As can be seen from FIG. 5, a circular plug 35 is provided centrally between the flat-pin plugs 34, associated with the lower region of curvature K8, this circular plug likewise projecting into the plug receptacle space 21.

When the appliance stem St has been inserted, this circular plug 35 serves to transmit signals from the power switch 23 arranged in the appliance stem St or in its handle 22.

Both the flat-pin plugs 34 and the circular plugs 35 are electrically conductive and are connected at the rear, in the region of the plug 29 or of the plug base 30, to corresponding connection lines 36, which inside the motor casing G lead to electronics or the like.

The position of plug 29 and plug base 30 is selected such that a distance 13, measured from the end face 33 to the opening of the plug receptacle 21, corresponds to the length 11 of the portion A of the mains plug-in female connector N. In the exemplary embodiment shown, in accordance with the mains plug-in female connector N, a dimension 13 of 35 mm is selected. This furthermore results in the dimension 13 of the plug receptacle 21 being equal to the dimension 12 of the female receptacle 9.

Furthermore, the arrangement is such that the flat-pin plugs 34 and the circular plug 35 end at a distance from the opening 37. This also applies to the flat-pin plugs 12 in the female receptacle 9.

Figures 15, 16:
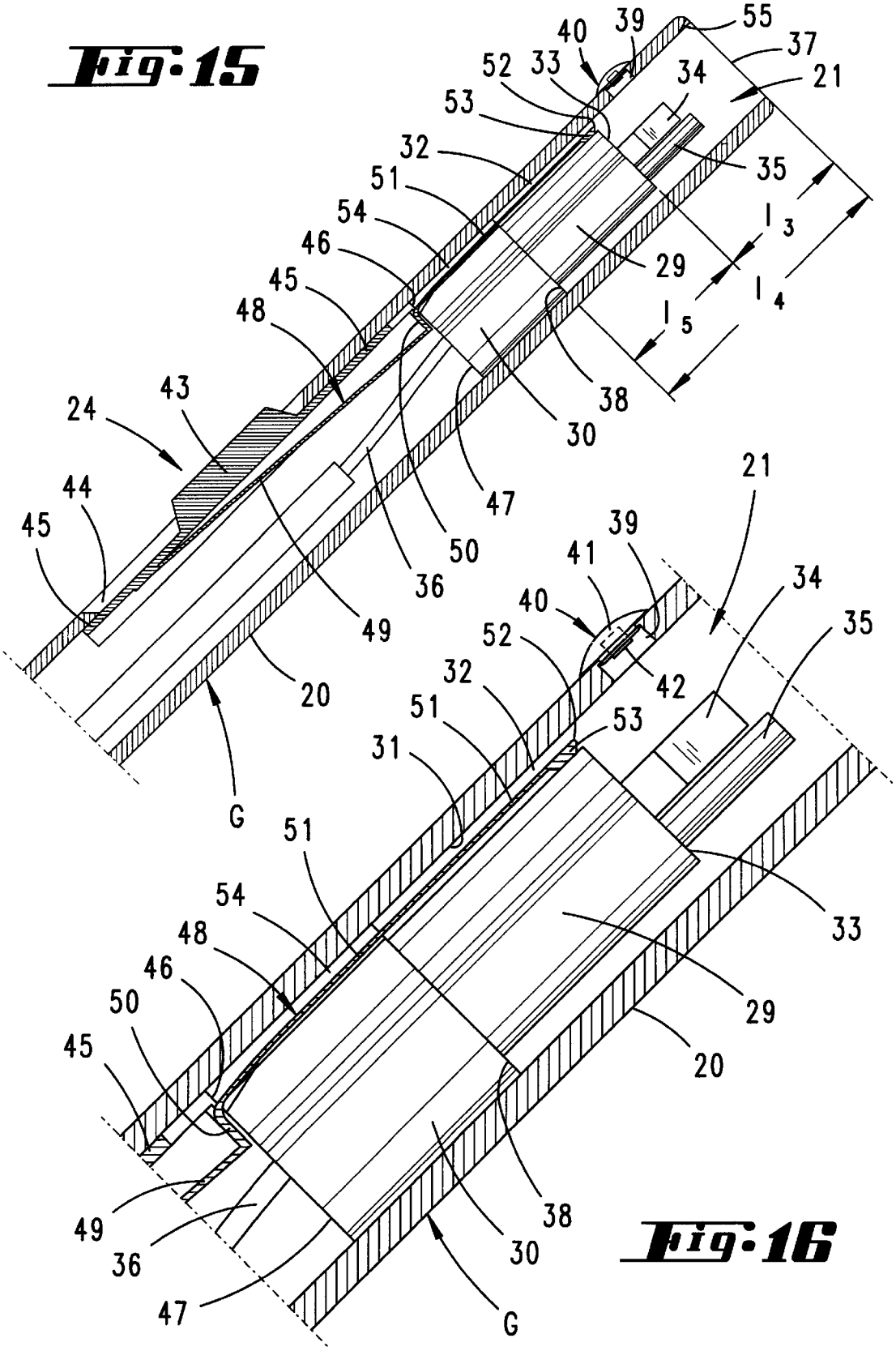
FIG. 15 shows a sectional illustration of the region of the plug receptacle close to the motor casing.
FIG. 16 shows an enlargement of part of FIG. 15.

The total length 14 is calculated by adding the first free length 13 and the length 15 of the freely protruding portion of the plug 29, measured from the root region 38 to the end face 33 (shown in this regard FIG. 15). A preferred design here is one in which, as shown, the dimension 14 corresponds to at least double the dimension 13. In the exemplary embodiment shown, the dimension 14 measures 80 mm, resulting in a freely protruding length 15 of the plug 29 of preferably 45 mm.

In the free regions between opening 37 and end face 33 of the plug 29, the plug receptacle 21 has a latching receptacle 39, into which, for example, the latching boss 18 of the mains plug-in female connector N can latch. This latching receptacle 39 is provided with an ejector 40 for disengaging a latching stud which passes into the latching receptacle 39. The ejector 40 comprises a flexible plastic part 41 with an incorporated metallic spring part 42, which projects into the latching receptacle 39. This spring part 42 may also consist of rigid plastic. The flexible plastic part 41 is held in the region of the latching receptacle 39, so that simply by pressing on this plastics part 41, the spring part 42 is displaced in such a manner that a latching boss resting in this latching receptacle 39 is moved out of the receptacle in order to release the latching.

As already mentioned, a power switch 24, which is designed as a sliding switch, is arranged in the extension arm 20 of the motor casing G. In the sectional illustrations shown in FIG. 15 to 24, only the sliding actuation button 43 of the power switch 24 is illustrated, i.e. the potentiometer/switch module to be actuated by the button 43 is omitted. However, the button 43 is connected to this module in a known manner, so that sliding movements of the button 43 are transmitted directly to the module for switching and controlling the rotation of the motor.

The sliding actuation button 43 is exposed in a longitudinal slot 44 in the wall of the extension arm 20. The button 43 projects through this longitudinal slot 44 in order for the button 43 to be reliably held. On the underside, i.e. on the internal wall of the extension arm sleeve, the actuation button 43 has a flange-like collar 45, the width of which, measured transversely to the longitudinal extent of the extension arm 20, is selected to be larger than the width of the longitudinal slot 44, measured in the same direction. The length of the collar 45, measured in the longitudinal extent of the extension arm 20, corresponds to approximately 1.5 times the length of the longitudinal slot 44, measured in the same direction, a length of the handle 43, measured in the same direction, corresponding to approximately half the length of the longitudinal slot. Thus the longitudinal slot 44 is covered on the underside over the entire travel of the button 43 or of the power switch 24, for example in order to protect the components arranged beneath the longitudinal slot 44, such as for example the potentiometer/switch module, from dust.

The result is thus a travel of the button 43 or of the power switch 24 of about 20 to 25 mm.

In a basic position in accordance with FIG. 15, an upper width edge 46 of the collar 45 extends to the height of a plug rear side 47.

Furthermore, the power switch 24 or the sliding actuation button 43 of the latter has a remote-actuation extension 48 which, starting from an underside of a region of the collar 45 which is remote from the plug 29, extends in a basic position in accordance with FIG. 15 as far as the end face 33 of the plug 29.

In concrete terms, the design of the remote-actuation extension 48 is selected such that initially a portion starting from the underside of the collar 45 and including an acute angle with the latter, extends as far as into the region of the upper width edge 46 of the collar 45. This portion is denoted in the drawings by the numeral 49 and is designed as a rigid portion with side walls which are supported against the underside of the collar 45 or are integrally connected thereto in terms of material. At that end region of the portion 49 which faces the upper width edge 46 of the collar 45 is formed a stop 50 which is directed perpendicular to the collar 45 and extends from the free end of the portion 49 as far as the underside of the collar 45.

A second section 51, protruding freely in the direction of the plug receptacle 21, of the remote-actuation extension 48 is integrally moulded on the stop 50 in the region of the transition from stop 50 to collar 45. This freely protruding design of the second portion 51 provides the latter with the possibility of resilient deflection. At its free end 52, the remote-actuation extension 48 or its second portion 51 has a latching projection 53, which is formed as a boss-like protrusion facing downwards, i.e. away from the plug receptacle inner wall 31.

The freely protruding portion 51 of the remote-actuation extension 48 lies, at least in the region of the latching projection 53, in the annular free space 32 formed between plug 29 and plug receptacle inner wall 31. To pass through the plug-base region, the plug base 30 has a groove 54 which is open towards the plug receptacle inner wall 31, the side walls of which groove simultaneously provide lateral guidance for the portion 51.

In a corresponding manner to the female receptacle 9, the plug receptacle 21 also has an inclined run-up surface 55 which moves a latching boss counter to a spring during a plug-in operation.

A plug-in female connector 57 is positioned at a distance 16 from the opening 56 in that free end region of the appliance stem St which is remote from the handle 22, is illustrated in FIG. 6 and, as already mentioned, is of tubular design. The said plug-in female connector is, for example, adhesively bonded to the inner wall of the tubular appliance stem St.

In a similar manner to the mains plug-in female connector N, the plug-in female connector 57 has two flat-pin plug receptacles 58 and a circular-plug receptacle 59 arranged between these two flat-pin plug receptacles 58. By contrast to the mains plug-in female connector N, in this plug-in female connector 57 all three receptacles 58 and 59 are conductive and are connected at the rear of the plug-in female connector 57 to a connection line 60 running in the appliance stem St. The other ends of the two wires of the flat-pin plug receptacles 58 are connected to the flat-pin plugs 12 of the female-receptacle-side plug 14. The wire connected to the circular-plug receptacle 59 leads to the power switch 23 arranged in the handle 22. These connections are not illustrated in more detail.

The dimension 16 by which the plug-in female connector 57 is set back from the opening 56 in the appliance stem St corresponds to the dimension 15 of the freely protruding plug 29 in the plug receptacle 21 or the length of the free space 32 formed between plug 29 and plug receptacle inner wall 31.

The cross-sectional area of the hollow section 61 formed over the length 16 is matched in the region of its outer contour to that of the mains plug-in female connector N. A line of curvature K9 running above a dividing line y''' corresponds in terms of its design to the line of curvature K1 of the mains plug-in female connector N and thus also essentially to the line of curvature K5 in the region of the plug receptacle 21. The line of curvature K10 running below the dividing line y''' accordingly corresponds to the line of curvature K2 of the mains plug-in female connector N and also essentially to the line of curvature K6 in the region of the plug receptacle 21.

The wall thickness of the hollow section 61 is selected to match the width of the free space 32 in the plug receptacle 21. In the exemplary embodiment shown, the hollow section 61 has a wall thickness of about 3 mm. This results in inner lines of curvature K11 and K12 which essentially correspond to the lines of curvature K7 and K8 of the outer contour of the plug 29.

Furthermore, the design is selected such that the length 16 of the hollow section 61 corresponds to approximately 2.3 times the largest free dimension of the cross-section of the appliance stem, which largest free dimension can be equated to the dimension b of the mains plug-in female connector N.

Approximately at the level of the plug-in female connector 57, the appliance stem St has a latching boss 62 which projects beyond the outer surface and, in a manner corresponding to the mains plug-in female connector N, is resilient perpendicular to the extent of the flat-pin plug receptacles 58 of the plug-in female connector 57. This latching boss 62 is illustrated in FIGS. 17 to 22.

On the upper outer surface, described by the line of curvature K9, of the hollow section 61, on which outer surface the latching boss 62 is arranged, the hollow section 61 has a latching recess 63 positioned close to the opening 56.

Figures 17, 18:
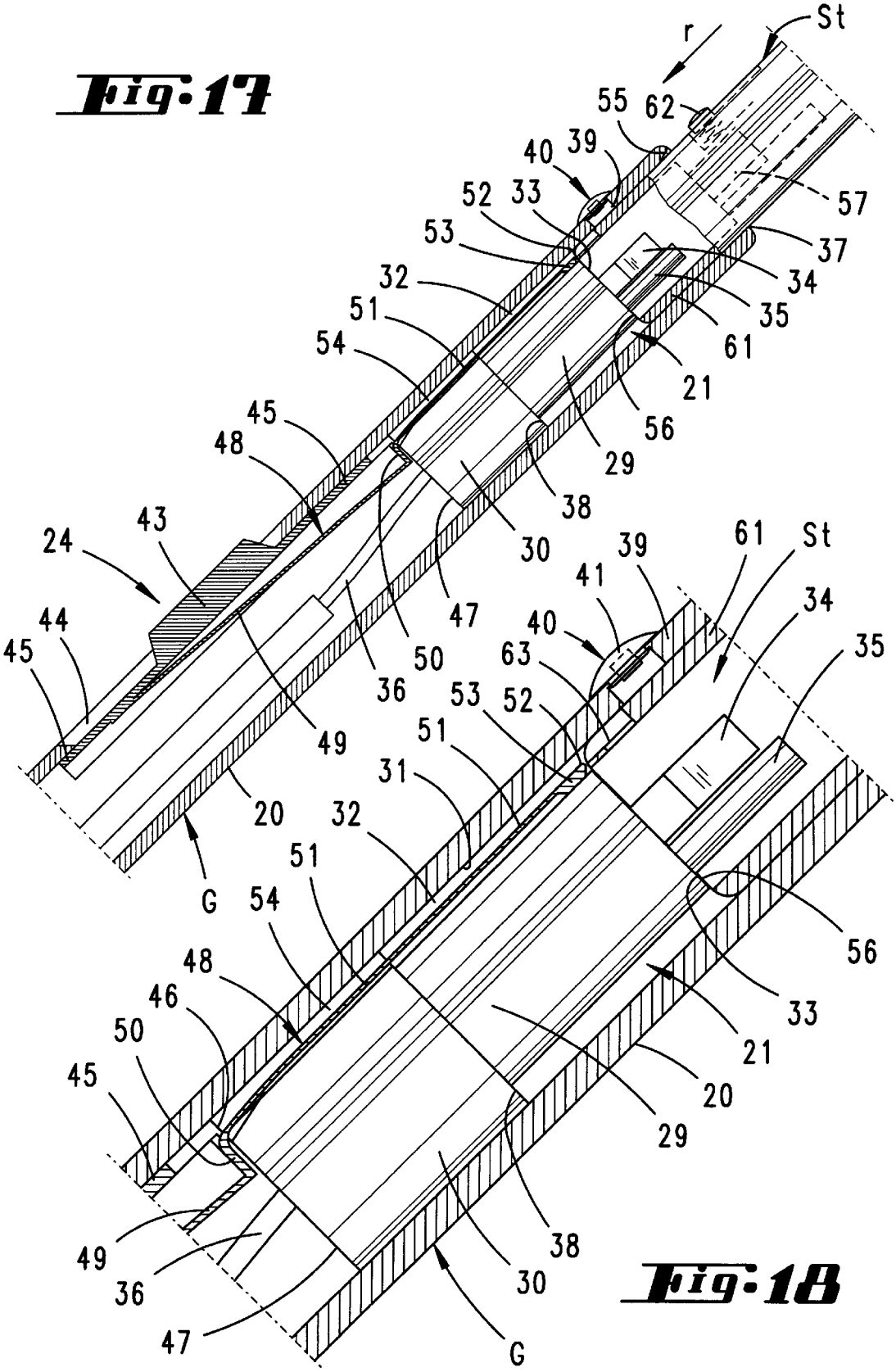
FIG. 17 shows a further view of the vacuum cleaner of FIG. 15, but with the appliance stem pushed partially into the plug receptacle, this end region of the appliance stem being partially cut away.
FIG. 18 shows a further view of the vacuum cleaner of FIG. 16, but relating to the position in accordance with FIG. 17.
Figures 19, 20:
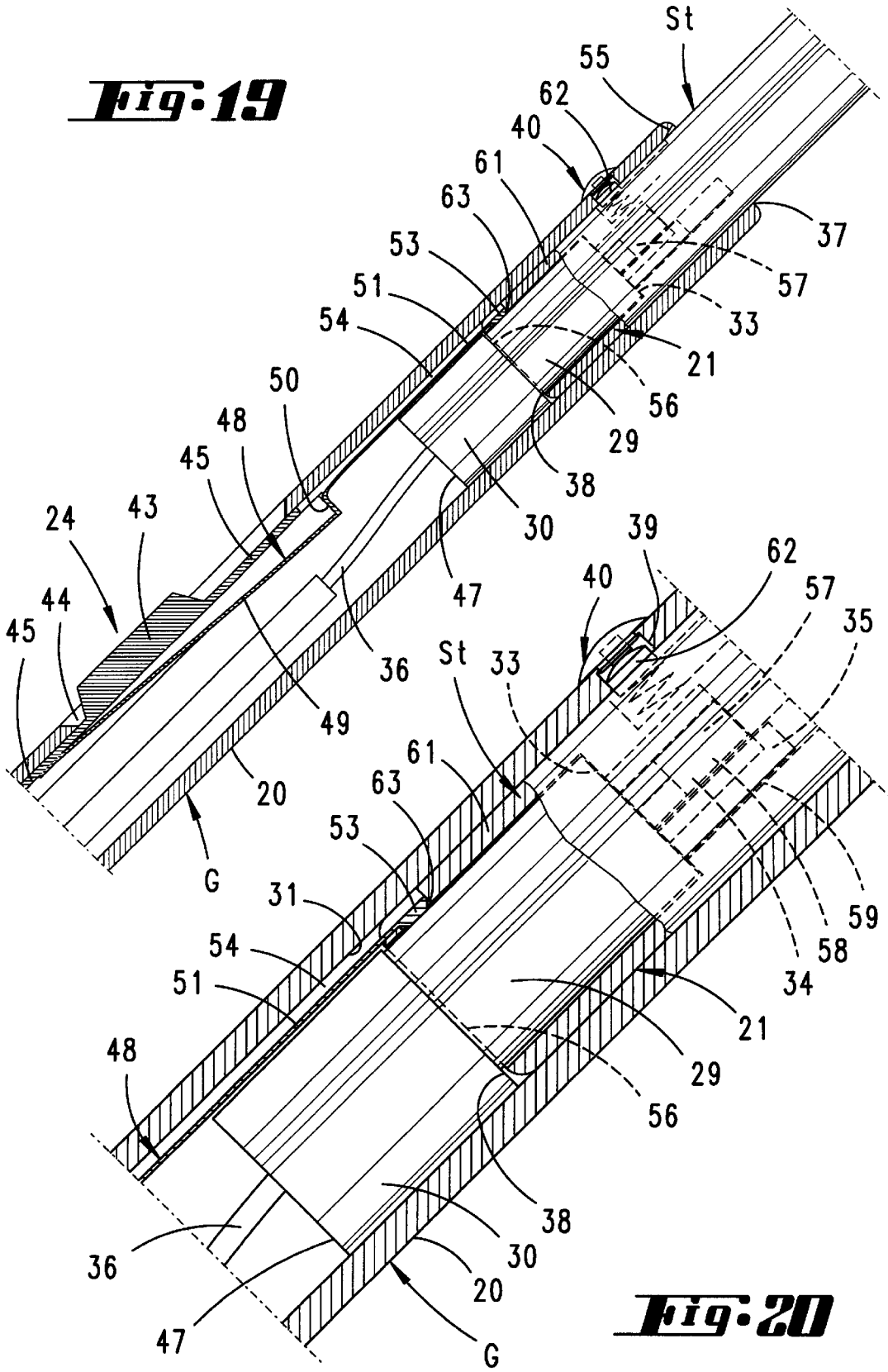
Figure 21:
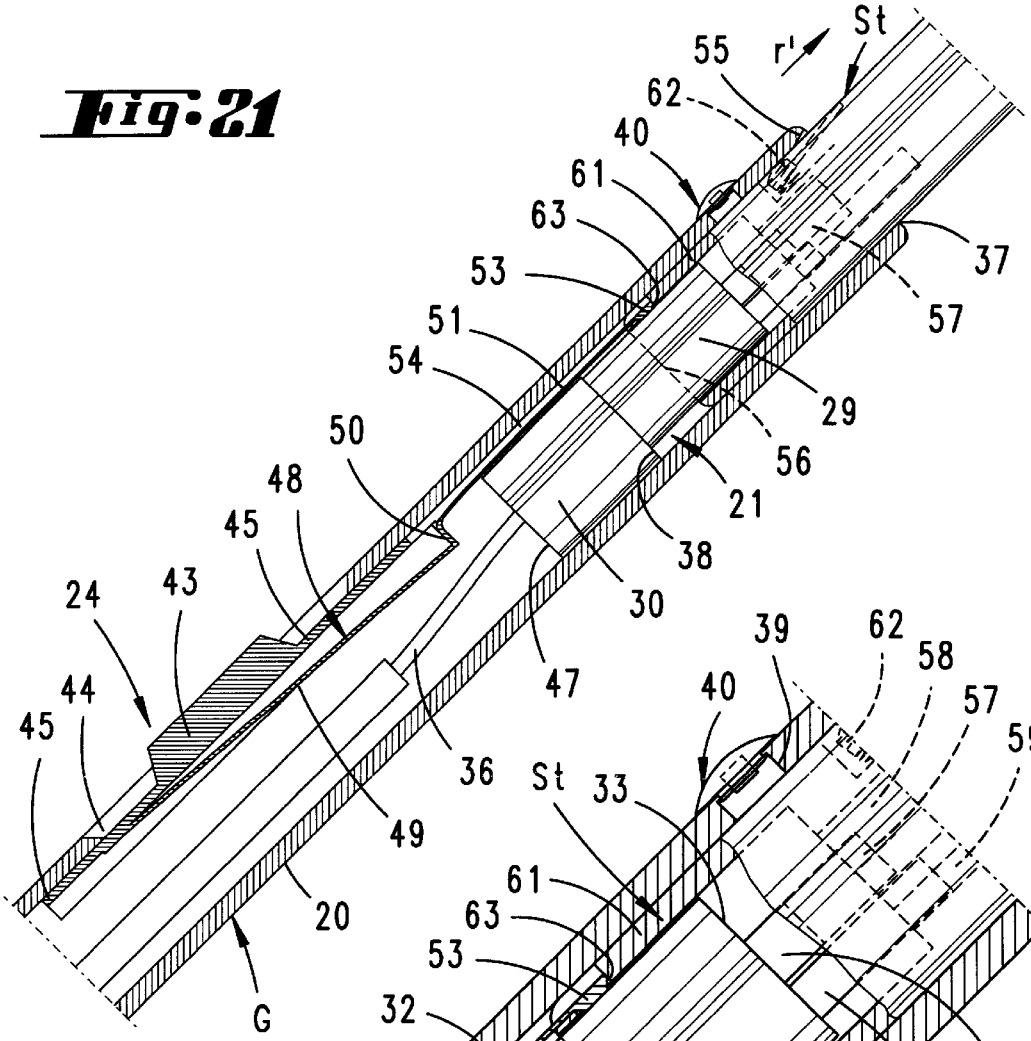
FIG. 21 shows a further view of the vacuum cleaner of FIG. 19, but illustrating an intermediate position in the course of pulling the appliance stem out of the plug receptacle.
Figure 22:
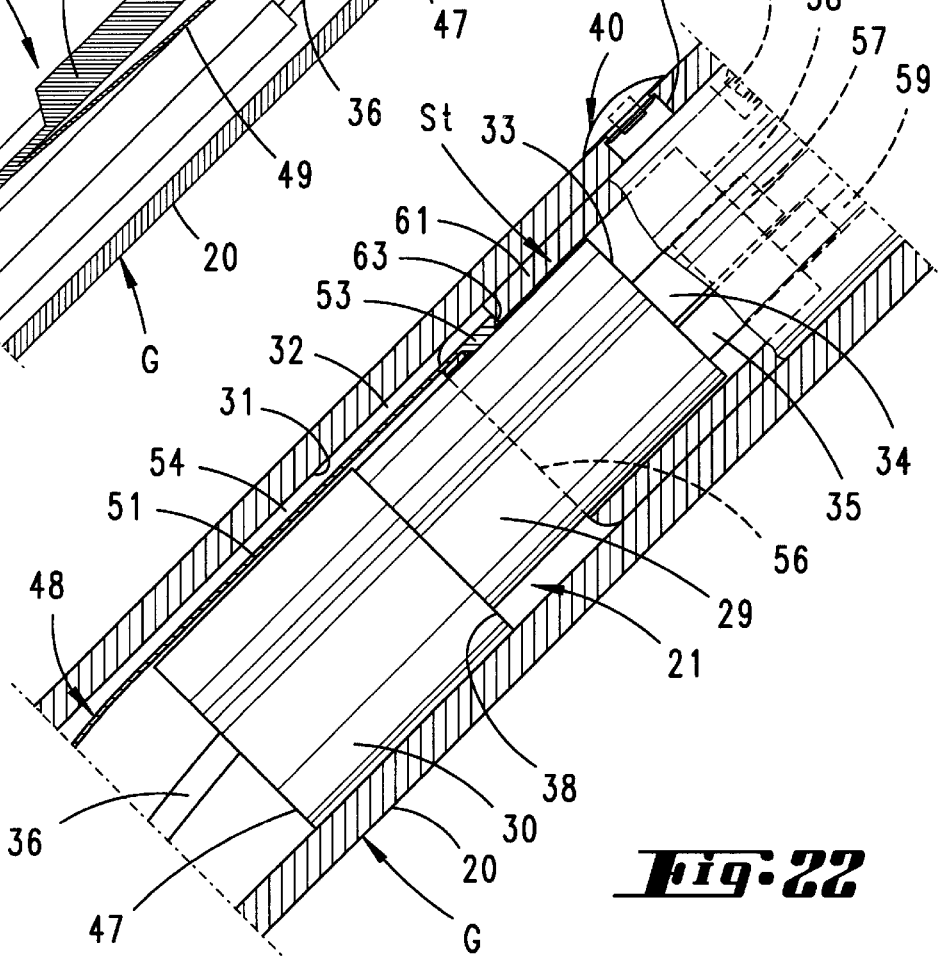
FIG. 22 shows a further view of the vacuum cleaner of FIG. 20, but relating to the position in accordance with FIG. 21.

If the plug-in female-connector-side free end of the appliance stem St is pushed into the plug receptacle 21, initially the end of the wall of the hollow section acts on the free end 52 of the remote-actuation extension 48 in the region of the opening 56, the extension initially being positioned at the level of the plug end face 33. In this position, the flat-pin plugs 34 and the circular plug 35 still rest free in the hollow section 61 of the appliance stem St. This position is illustrated in FIGS. 17 and 18. Further displacement of the appliance stem St in the direction of the arrow r initially causes the resilient end 52 of the remote-actuation extension 48 to deform such that as the appliance stem is pushed in further, the latching projection 53 enters the latching recess 63. The result of this is that when the appliance stem St is displaced further in the direction r to reach the limit position in accordance with FIGS. 19 and 20, the remote-actuation extension 48 is entrained via the latching, resulting in the power switch 24 or its sliding actuation button 43 being moved into a maximum position. In the course of being pushed in, the appliance stem St, in the region of its hollow section 61, passes over the plug 29 of the plug receptacle 21, the hollow-section wall penetrating into the free space 32. Owing to the length ratios described above, in a limit position in accordance with FIGS. 19 and 20, the appliance stem St is supported, on one side, in the region of its opening-side end face, on the plug base 30 and, on the other side, in the region of its plug-in female-connector face, on the plug-side end face 33. The flat-pin plugs 34 and the circular plug 35 are received in the flat-pin plug receptacles 58 and the circular-plug receptacle 59 of the plug-in female connector 57 for coupling the electric lines.

In the limit position, the latching boss 62 of the appliance stem St latches into the latching receptacle 39 of the plug receptacle 21. This latching can only be eliminated intentionally by actuating the ejector 40 in such a manner that the spring part 42 embedded in the flexible plastic part 41 displaces the latching boss 62 back counter to the spring force.

The power connection is made via the coupling of mains plug-in female connector N and female receptacle 9 in accordance with FIG. 14. In such a configuration, which is illustrated as a whole in FIG. 1, the vacuum cleaner 1 can be used as a manually operated appliance for working on the floor. The power switch 23 in the handle 22 is used to switch the suction motor or its power control on and off. The power switch 24 in the motor casing G, which switch is connected in series with this power switch 23, is moved into a full-load position.

To use the vacuum cleaner 1 for working above the floor, the appliance stem St is removed from the motor casing G. In the process, as the appliance stem St is moved backwards in the direction of the arrow r' in accordance with FIGS. 21 and 22, the remote-actuation extension 48 is pulled along with it, owing to the latching between latching projection 53 and latching recess 63. This pulling along is only ended once the stop 50 of the remote-actuation extension 48 strikes against the rear side 47 of the plug. The latching projection 53 then leaves the latching recess 63, owing to the resilient design of the portion 51. This position defines the OFF position of the power switch 24. It is thus ensured that the suction motor is switched off when the appliance stem St is removed.

Figure 23:
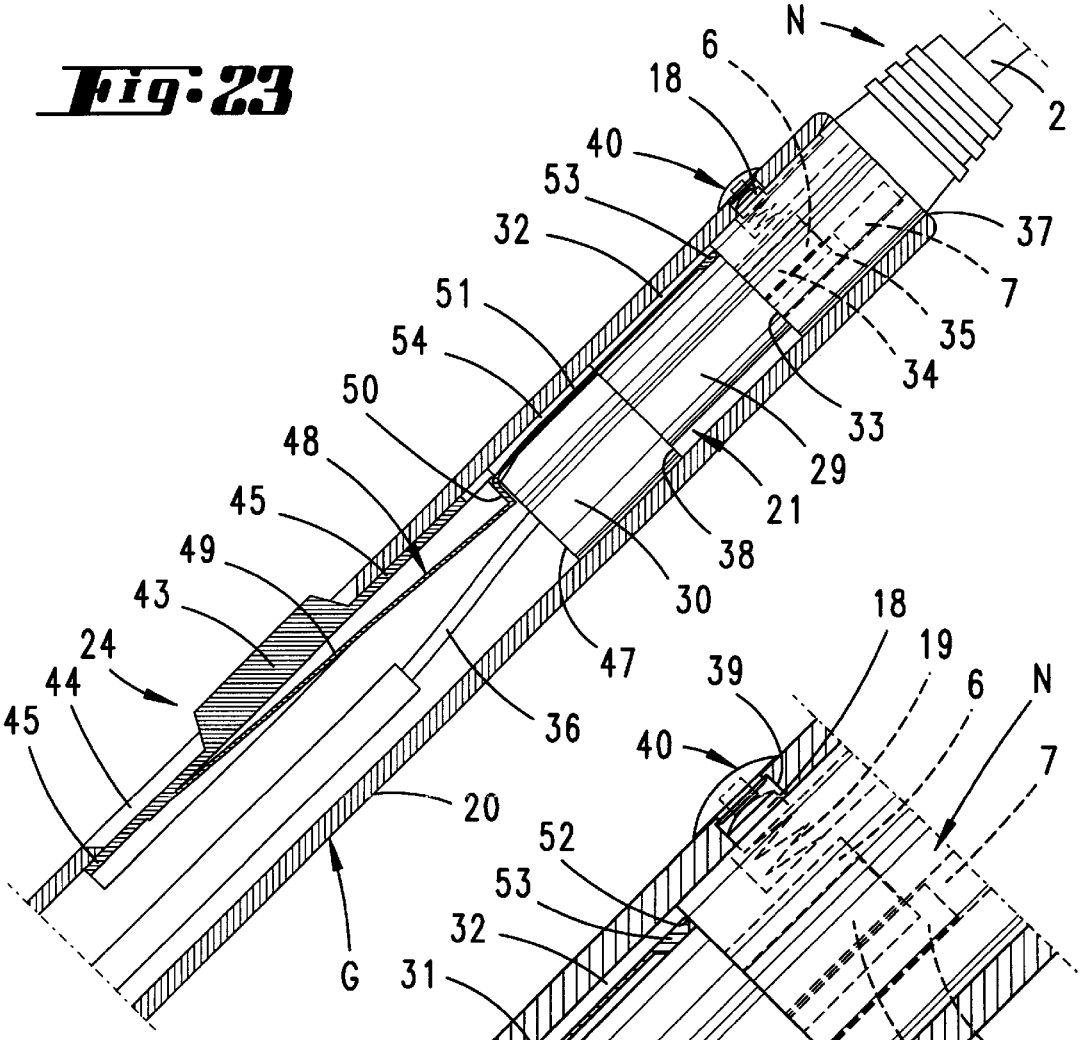
FIG. 23 shows a further view of the vacuum cleaner of FIG. 15, but with the mains plug-in female connector plugged into the plug receptacle.
Figure 24:
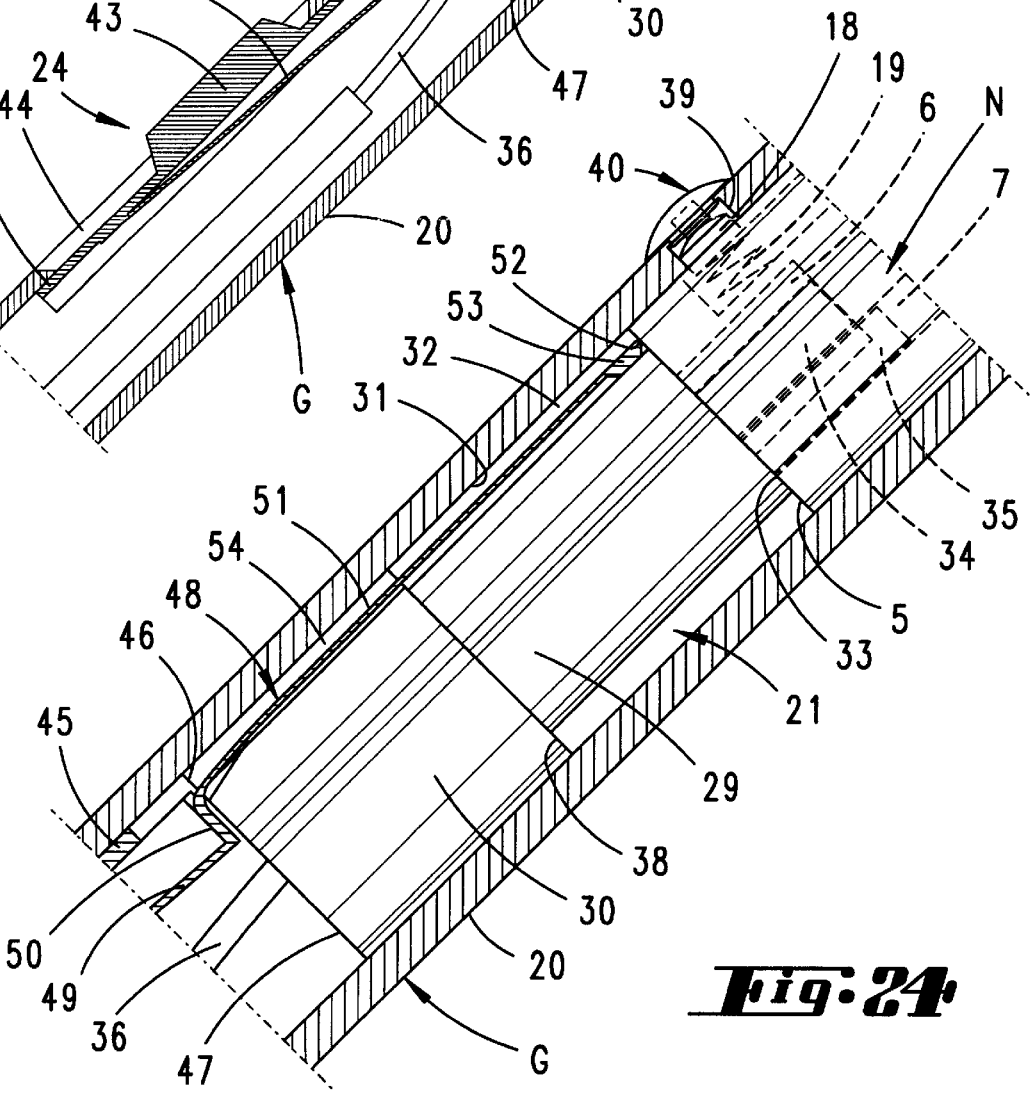
FIG. 24 shows a further view of the vacuum cleaner of FIG. 16, but relating to the position in accordance with FIG. 23.

After removing the appliance stem St, the mains plug-in female connector N can be plugged into the plug receptacle 21, as illustrated in FIGS. 23 and 24, in which it can be seen that the mains plug-in female connector N is supported by its end face 5 on the end face 33 of the plug 29. Here too, the flat-pin plugs 34 and the circular plug 35 locate their corresponding flat-pin plug receptacle 6 and circular-plug receptacle 7, respectively, in the mains plug-in female connector N, the circular-pin receptacle 7, as already mentioned, being designed only as a blind receptacle. Owing to the fact that the mains plug-in female connector N does not have a protruding hollow section which could enter the free space 32, the mains plug-in female connector N does not act on or displace the remote-actuation extension 48. The result of this is that with such a configuration, illustrated as a whole in FIG. 3, the power switch 24 initially remains in an OFF position. A manual actuation of the power switch 24 on the part of the user has no detrimental effect on the region of the plug receptacle 21. The vacuum cleaner 1 is thus designed in an extremely simple manner for working above the floor, the power supply being brought about directly.

Owing to the above-described configurations, it is possible to plug the mains plug-in female connector N both into the appliance-stem-side female receptacle 9 and into the casing-side plug receptacle 21 in order to bring about the power supply. The appliance stem St, on the other hand, can only be inserted into the plug receptacle 21 of the motor casing G. Owing to the hollow-section-like design of the end of the appliance stem, the power switch required for the corresponding work is activated mechanically. Furthermore, the design of the end of the appliance stem means that high forces and moments can be transmitted from the appliance stem St to the appliance casing G.

We claim:

1. Vacuum cleaner comprising:

a motor casing with a plug receptacle and a connectable filter chamber (10), and an appliance stem (St) being constructed to plug into the plug receptacle (21);

a power switch (24) arranged in the motor casing to be actuated upon a plugging in of the appliance stem;

wherein the power switch is a sliding switch connected to a remote-actuation extension (48), which is acted on by plugging in the appliance stem (St) which simultaneously actuates the power switch (24).

2. Vacuum cleaner according to claim 1, wherein the remote-actuation extension (48) has a latching projection (53) on an appliance-stem-side end (52) of the extension (48) adjacent a location of reception of the appliance stem for interaction with a latching recess (63) on the appliance stem (St).

3. Vacuum cleaner according to claim 1, wherein an appliance-stem-side end (52) of the remote-actuation extension (48) is entrained, when the appliance stem (St) is pulled out, to the maximum extent into a position which is displaced rearwards with regard to an opening (37) of the plug receptacle (21).

4. Vacuum cleaner according to claim 1, wherein the appliance-stem-side end (52) of the remote-actuation extension (48) can be displaced within a gap between a plug receptacle inner wall (31) and a plug (29) arranged in the plug receptacle (21).

5. Vacuum cleaner according to claim 4, wherein the displacement is limited by a stop (50) on a plug rear side (47).

6. Vacuum cleaner according to claim 4, wherein the outermost position of the appliance-stem-side end (52) of the remote-actuation extension (48) is aligned with the plug (29) in such a manner that contact lugs (34) arranged on the plug (29) project beyond the appliance-stem-side end (52) of the remote-actuation extension (48).

7. Vacuum cleaner comprising:

a motor casing with a plug receptacle and a connectable filter chamber (10), and an appliance stem (St) being constructed to plug into the plug receptacle (21);

a plug (29) having contact lugs (34)

wherein the plug (29) is arranged set back in the plug receptacle (21) in such a manner that the front ends of the contact lugs (34) are situated at a distance from an opening (37) of the plug receptacle (21).

8. Vacuum cleaner according to claim 7, wherein the plug (29) is arranged protruding freely in the plug receptacle (21).

9. Vacuum cleaner according to claim 7, wherein the plug (29) is fastened in the plug receptacle (21) by means of a plug base (30).

10. Vacuum cleaner according to claim 7, wherein the appliance stem (St) can be pushed into the plug receptacle (21) over a dimension (14) which corresponds to at least 1.5 times, preferably double, a maximum free dimension of an appliance-stem cross-section.

11. Vacuum cleaner according to claim 7, wherein the distance (13) from the opening (37) of the plug receptacle (21) to the foot of the contact lugs (34) approximately corresponds to the maximum dimension of the appliance-stem cross-section.

12. Vacuum cleaner according to claim 7, wherein the appliance stem (St) and/or a mains plug-in female connector (N) has a latching stud (18, 62) which projects perpendicularly to a plug-in direction (r) and latches in a latching receptacle (39) of the plug receptacle (21).

13. Vacuum cleaner according to claim 12, wherein the latching receptacle (39) is provided with an ejector (40) for disengaging the latching stud (18, 62).

14. Vacuum cleaner according to claim 13, wherein the ejector (40) comprises a flexible plastic part (41) with an integral metallic, sprung part (42).

15. Vacuum cleaner comprising a motor casing with a plug receptacle and a connectable filter chamber (10), and an appliance stem (St) being constructed to plug into the plug receptacle (21);

a mains plug-in female connector (N) capable of being plugged into the appliance stem (St);

wherein the appliance stem (St) on one side has a plug (14) for interacting with the mains plug-in female connector (N), the plug (14) being set back in a socket receptacle (9) of the appliance stem (St) by a dimension (b) of the maximum free cross-section of the mains plug-in female connector (N), the appliance stem (St) is designed on the other side as a plug-in female connector (57) for interacting with a plug (29) of the plug receptacle (21), which plug is set back by an identical distance with regard to the plug (14), but it being possible for a hollow section (61) of the appliance stem (St) to at least partially cover the plug (29) of the plug receptacle (21), and the plug-in female connector (57) if the appliance stem (St) is set back in the hollow section (61) by an amount of coverage distance (15).

* * * * *